US005353866A

United States Patent [19]

Ueda et al.

[11] Patent Number: 5,353,866

[45] Date of Patent: Oct. 11, 1994

[54] HEAT TRANSFER FINS AND HEAT EXCHANGER

[75] Inventors: Hironobu Ueda, Kudamatsu; Toshio Hatada, Tsuchiura; Yoshifumi Kunugi, Nirasaki; Tomihisa Oouchi, Tsukuba; Sigeo Sugimoto, Ushiku; Tamio Shimizu; Kyoji Kohno, both of Ibaraki, all of Japan

[73] Assignee: Hitachi, Ltd., Tokyo, Japan

[21] Appl. No.: 38,190

[22] Filed: Mar. 29, 1993

Related U.S. Application Data

[63] Continuation of Ser. No. 574,526, Aug. 28, 1990, abandoned, which is a continuation of Ser. No. 279,120, Dec. 2, 1988, abandoned.

[30] Foreign Application Priority Data

Dec. 4, 1987 [JP] Japan ..... 62-305804
Apr. 20, 1988 [JP] Japan ..... 63-95614

[51] Int. Cl.[5] ..... F28F 1/32; F28D 9/00

[52] U.S. Cl. ..... 165/151; 165/181; 165/182; 62/476

[58] Field of Search ..... 165/151, 62, 181, 182; 62/476

[56] References Cited

U.S. PATENT DOCUMENTS 3,608,628 9/1971 Leonard, Jr. ..... 165/62
4,300,629 11/1981 Hatada et al. ..... 165/151
4,614,230 9/1986 Sakuma et al. ..... 165/151
4,705,105 11/1987 Cur ..... 165/151
4,723,599 2/1988 Hanson ..... 165/151
4,748,830 6/1988 Oouchi et al. ..... 62/476
4,791,984 12/1988 Hatada et al. ..... 165/151
4,821,795 4/1989 Lu ..... 165/151

FOREIGN PATENT DOCUMENTS 2518226 11/1975 Fed. Rep. of Germany ..... 165/151
0165497 12/1980 Japan ..... 165/151
0174495 9/1985 Japan ..... 165/151
62-252896 11/1987 Japan .

*Primary Examiner*—John K. Ford
*Attorney, Agent, or Firm*—Antonelli, Terry, Stout & Kraus

[57] ABSTRACT

Louver segments of a heat transfer fin each have a longitudinal central portion disposed at the center of the louver segment in a direction crossing the flow of a fluid and longitudinal end portions each disposed on either side of the longitudinal central portion and sectioned into parts. Each louver segment has a configuration such that an area of the longitudinal central portion projected in the direction of the flow of the fluid is larger than an area of each of the longitudinal end portions projected in the direction of the flow of the fluid, with respect to the same width of the passage of the fluid.

10 Claims, 9 Drawing Sheets

HEAT TRANSFER FINS AND HEAT EXCHANGER

This application is a continuation of application Ser. No. 07/574,526, filed Aug. 28, 1990, now abandoned, which in turn is a continuation of application Ser. No. 07/279,1120, filed Dec. 2, 1988 now abandoned.

BACKGROUND OF THE INVENTION

The present invention relates to heat exchangers and heat transfer fins used in heat exchangers such as air-cooled heat exchangers and, more particularly, to heat transfer fins which provide small resistances to the passage of air and exhibit excellent heat transferring performance and to heat exchangers incorporating such heat transfer fins.

In general, a heat exchanger, such as an air-cooled cross-fin-tube type heat exchanger used in an air conditioner, refrigerating machine or the like, comprises a large number of fins formed of aluminum sheets disposed in parallel and a plurality of heat transfer tubes extending through the parallel fins, with the heat transfer tubes and the fins being closely attached to each other by a suitable method such as tube expanding operation, and with the ends of the heat transfer tubes being connected together by U-shaped bends. One heat exchanging fluid, such as cold water, hot water or a refrigerant, is allowed to flow through the heat transfer tubes, while another heat exchanging fluid, which may typically be air, is allowed to flow outside the tubes at a suitable speed, so that exchange of heat is effected through the tube walls and the fins.

One type of heat transfer fins which may be used in such a heat exchanger is disclosed in, for example, Japanese Patent Laid-Open Publication No. 62-52896 and corresponding U.S. Pat. No. 4,791,984. A fin of this type provides a large resistance to the passage of fluid in the vicinity of the central portion of the fin that is disposed between two adjacent heat transfer tubes, while the fin provides a small resistance to the passage of fluid at the end portions of the fin that are on the opposite sides of the central portion, thereby enhancing the heat transferring performance.

Recent years have seen the demand for further enhancement in the heat transferring performance. However, since the above-described conventional fin comprises a single small piece of metal, there is a limit to any further reduction in the size of the fin from the viewpoint of rigidity, making it impossible to achieve any further enhancement of the heat transferring performance.

SUMMARY OF THE INVENTION

The present invention has been made to overcome the problem encountered by the prior art, and it is an object of the present invention to provide heat transfer fins which allow the speed of the fluid (air, for example) to be controlled in such a manner that the speed of the fluid is increased at portions of the fins where the difference in temperature between the fins and the fluid flowing through the gaps between the fins is large, thereby achieving an improvement in the heat transfer efficiency, and which allow the fin-forming louver segments to be sectioned into fin parts without causing any reduction in the strength of the entire fins.

To this end, according to the present invention, there is provided a heat transfer fin comprising louver segments each having a length extending in a direction that crosses a direction of the flow of a fluid, with each of the louver segments having a longitudinal central portion and longitudinal end portions each disposed on either side of the longitudinal central portion and sectioned into parts, and with each of the louver segments having a configuration such that an area of the longitudinal central portion projected in the direction of the flow of the fluid is larger than an area of each of the longitudinal end portions projected in the direction of the flow of the fluid, with respect to the same width of the passage of the fluid.

With the above-stated arrangement, the resistance to the passage of the fluid is small at portions of the fins around the heat transfer tubes where the difference in temperature between the fluid and the fins is large, as compared with that in the central portions. Consequently, the speed of the fluid flow is increased around the heat transfer tubes, thereby enhancing the heat transferring performance. Further, since each of the longitudinal end portions disposed on the opposite sides of the longitudinal central portion is sectioned into parts, the fin can be sectioned into small parts without causing any reduction in the mechanical strength of the fin. In this manner, the overall heat transferring performance is enhanced and the rigidity of the fin is ensured.

DESCRIPTION OF THE PREFERRED EMBODIMENTS

The present invention will be described hereunder with reference to the drawings.

Figure 1:
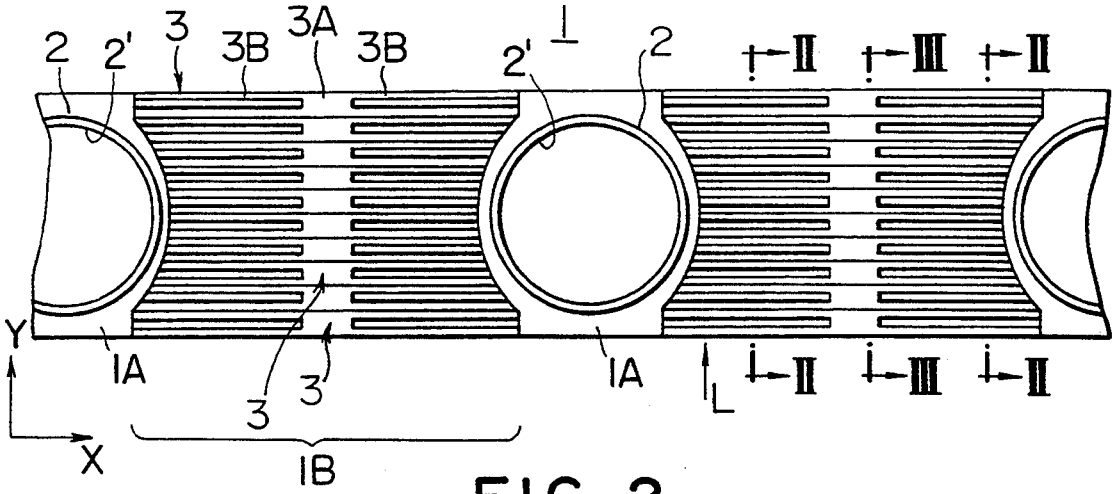
FIG. 1 is a plan view of a heat transfer fin in accordance with one embodiment of the present invention.
Figure 2:
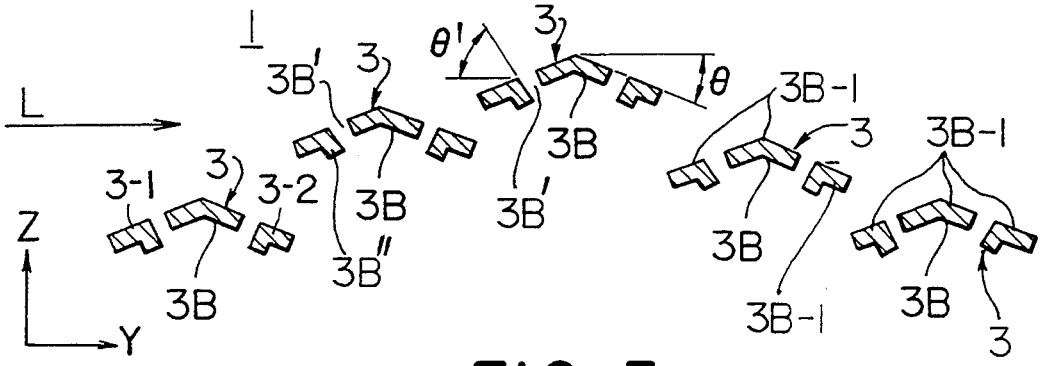
FIG. 2 is an enlarged sectional view taken along the line II—II in FIG. 1.
Figure 3:
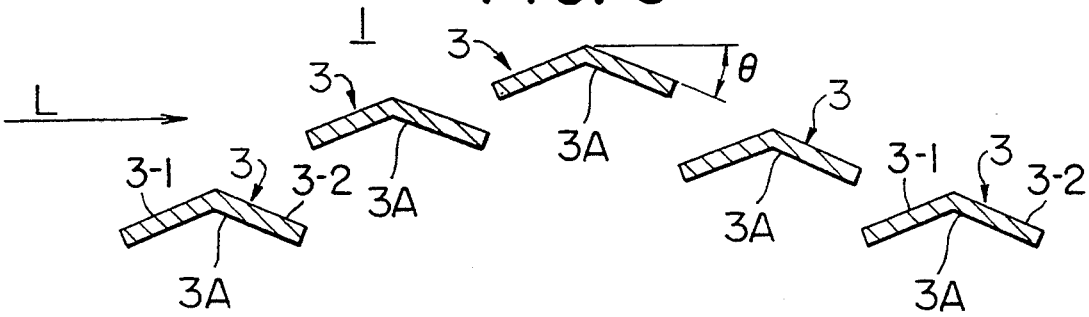
FIG. 3 is an enlarged sectional view taken along the line III—III in FIG. 1.

A heat transfer fin shown in FIG. 1 is for a heat exchanger of the type that has at least two heat transfer tubes (not shown) for a first fluid flowing therethrough. The fin comprises a fin plate 1 which includes at least two tube mounting sections 1A spaced from each other in a longitudinal direction X of the fin plate 1 and a louvered section 1B extending between and connected to the two tube mounting sections 1A. The tube mounting sections 1A have collars 2 defining therein tube mounting holes 2' for receiving therein the heat transfer tubes in heat transfer contact with the collars 2 so that a second fluid (air, for example) can flow through a passage between the heat transfer tubes and across the lowered section 1B in heat transfer relationship therewith. The direction of the flow of the second fluid is shown by arrows L in FIGS. 2 and 3 and is parallel to the widthwise direction Y of the fin plate 1.

The louvered section 1B has a plurality of elongated and substantially parallel louver segments 3 arranged in the direction L of the flow of the second fluid (the widthwise direction Y of the fin plate 1) and extending in the longitudinal direction X of the fin plate 1 and substantially in parallel with a line extending between the axes of the tube mounting holes 2' in the tube mounting sections 1A. The louver segments 3 have substantially parallel longitudinal side edges separated from each other in the thicknesswise direction Z of the fin plate 1, as will be seen in FIGS. 2 and 3. As will be seen in FIG. 1, each of the elongated louver segments 3 has longitudinal end portions 3B respectively integrally connected to the two tube mounting sections 1A and a longitudinal central portion 3A extending between and integrally connected to the longitudinal end portions 3B.

Each of the longitudinal end portions 3B of each of the elongated louver segments 3 is formed therein with slits 3B'. Due to the angled configuration of each louver segment 3, each louver segment has two inclined walls 3-1 and 3-2 in which the slits 3B' in the longitudinal end portions 3B are formed, respectively, to allow a part of the flow of the second fluid to pass therethrough, so that the resistance imparted by each louver segment 3 to the flow of the second fluid across the louvered section 1B is reduced in each of the longitudinal end portions 3B to allow the second fluid to flow across the louvered section 1B at a higher speed at zones of the passage adjacent the heat transfer tubes than at a central zone of the passages adjacent the longitudinal central portion 3A of each louvered segment 3.

In the preferred embodiment shown in FIGS. 1–4, the slits 3B' extend longitudinally of each elongated louver segment 3 to divide each of the longitudinal end portions 3B into a plurality of small parts 3B-1 arranged in the direction L of the flow of the second fluid and extending longitudinally of the elongated louver segment 3. Each of the slits 3B' has an edge 3B'' bent at an angle $\theta'$ measured between a surface of the edge facing the slit 3B' and a second plane parallel to the direction L of the flow of the second fluid and perpendicular to the axes of the tube mounting holes 2', i.e., perpendicular to the direction Z of the thickness of the fin plate 1.

The central portions 3A of the louver segments 3 are offset from each other in the direction crossing the direction L of the fluid flow. The end portions 3B of the louver segments 3 are also offset in a similar manner.

As described above, in the heat transfer fin in accordance with FIGS. 1–4 the central portion 3A of each louver segment 3 has an angled configuration in its section taken in the direction L of the fluid flow, and each end portion 3B of each louver segment 3 has an angled configuration in its section taken in that direction. However, the central portion 3A of each louver segment 3 has a configuration that exhibits a greater resistance to the passage of fluid than that of each of the end portions 3B. In other words, the central portion 3A of each louver segment 3 is capable of exhibiting a greater resistance to the passage of fluid than that given by each end portion 3B.

Figure 5:
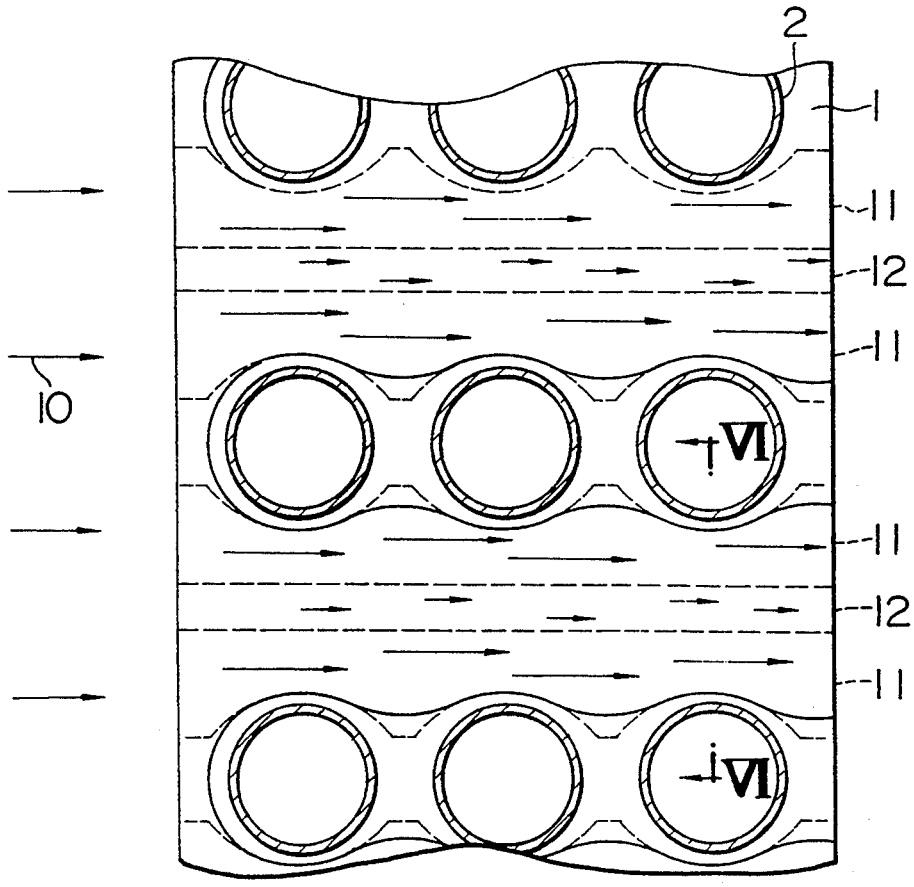
FIG. 5 is a view schematically illustrating the manner in which air flows across a heat transfer fin in accordance with the present invention.
Figure 6:
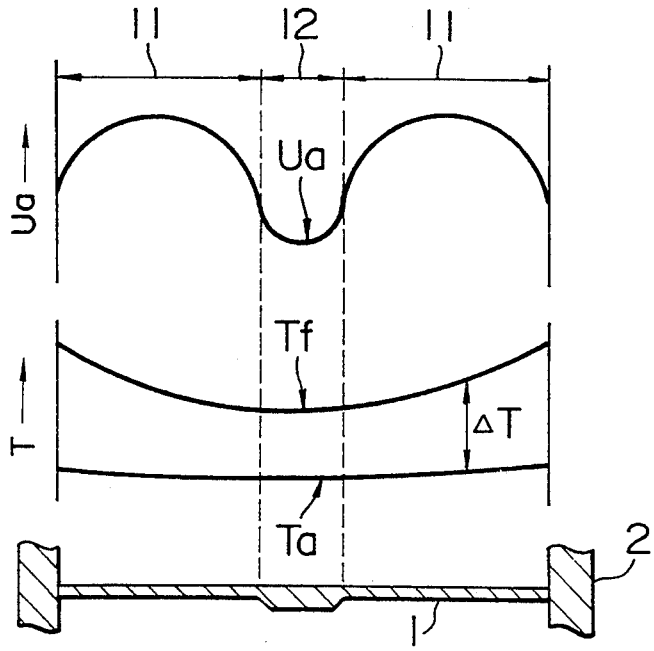
FIG. 6 graphically depicts a flow speed and temperature obtained in a section taken along the line VI—VI in FIG. 5 with a heat transfer fin in accordance with the present invention.
Figure 7:
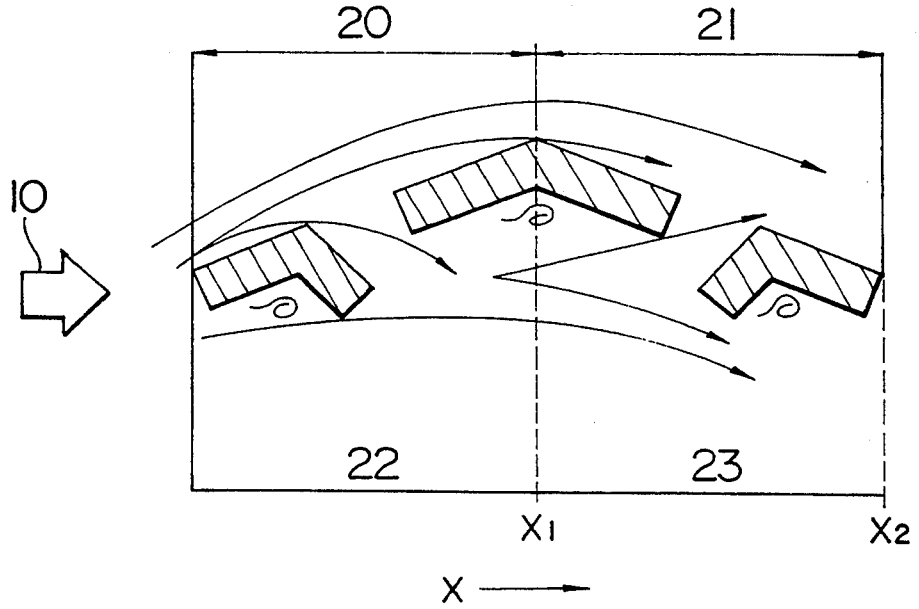
FIG. 7 schematically illustrates the manner in which air flows through one of the longitudinal end portions of each louver segment of the heat transfer fin in accordance with the present invention.

The fin of the embodiment of FIGS. 1–4 provides a large resistance to the fluid flow in the central portions 3A of the louver segments 3 and a small resistance to the fluid flow in the end portions 3B of the louver segments 3. Therefore, the air flows in the manner shown in FIG. 5. More specifically, regions 12 across which the fluid flows at a low speed are formed where the central portions 3A are disposed, while regions 11 across which the fluid flows at a high speed are formed on the opposite sides of each low speed region 12, i.e., where the end portions 3B are disposed. As shown in FIG. 6, the flow speed Ua is low in the region 12, while it is high in the regions 11. The temperature Tf of the fin and the temperature Ta of the fluid basically remain unchanged. As a result, the flow speed Ua can be increased at the regions 11 where the temperature difference $\Delta T$ ($=Tf-Ta$) is large, thereby allowing a significant increase in the heat exchange quantity Q. In contrast, in the low flow-speed regions 12, although the difference $\Delta T$ in temperature and the flow speed Ua are both small, their influences on the overall heat exchange quantity Q are considered to be small because their absolute values are inherently small. As shown in a part of the fluid flow passes through the gap between the angled small parts 3B-1 disposed in the region occupied by the upstream half of a convex side 20 of each louver segment 3 in each end portion 3B to flow into the region occupied by the upstream half concave side 22 of the louver segment 3 in the same end portion 3B, thereby reducing stagnation components occurring in the concave side. The part of the flow forms a mixed flow of laminar components and stagnation component accompanied by bubbles on the upstream half of the concave side 22 of the louver segment 3, then flows, from the region occupied by the downstream half of the concave side 23 of the louver segment 3, either downwards or into the region occupied by the downstream half of the convex side 21 of the louver segment 3 through the gap between the small parts 3B-1.

Figure 8:
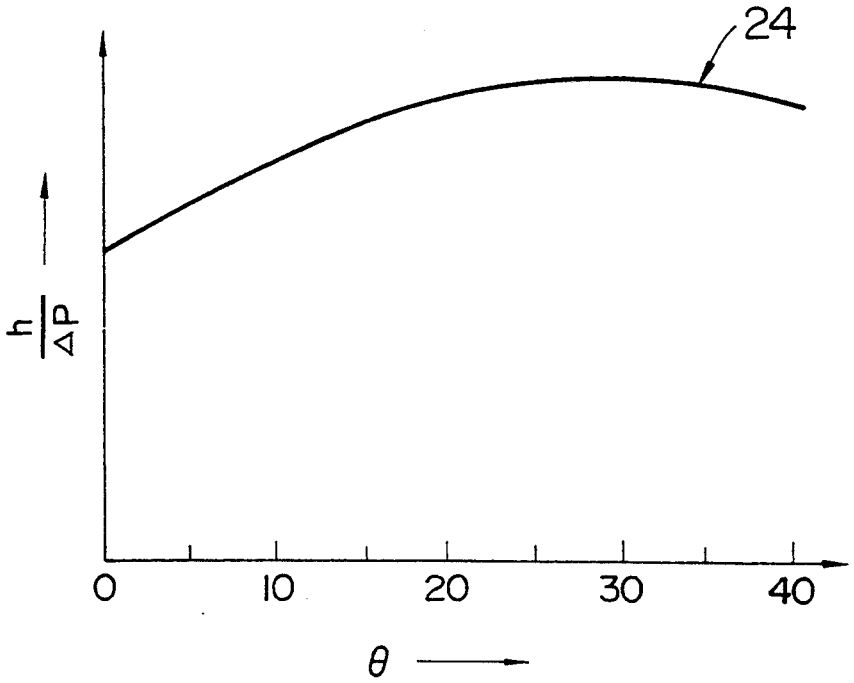
FIG. 8 is a graph showing a characteristic curve expressing the relationship between the heat transferring performance and the angle, that is obtained with the louver segment configuration shown in FIG. 7.

As described above, according to the present invention, the speed of flow is controlled in the longitudinal direction of the louver segments 3 to assure an enhancement in the heat transfer efficiency and reduce the stagnation in the concave sides 22 and 23 thereby improving the heat transferring performance. In this way, the overall heat transfer performance can be enhanced. Further, by virtue of the arrangement of each end portion 3B in which the angled louver segment is further sectioned into small parts 3B-1, there is no reduction in the rigidity of the entire fin, thereby ensuring a further enhancement in the upstream-edge effect achieved by sectioning the louver segments into small parts 3B-1. The angle $\theta$ is measured between the direction L of the fluid flow and one of the upper surfaces of each of the angle louver segments 3. In FIG. 8 the ordinate represents the ratio between the heat transfer rate h and the pressure loss $\Delta P$, while the abscissa represents the angle $\theta$ of the angled louver segment. As will be clearly seen from FIG. 8, the optimum angle $\theta$ of the louver segments in the end portions 3B is about 20 to 40 degrees. If this angle is smaller than 20 degrees, the air cannot easily flow through the gaps between the small parts 3B-1 of the louver segment, 3 whereas, if that angle is larger than 40 degrees, pressure loss of the fluid low is increased. Thus, angles outside the above-stated range are not suitable from the viewpoint of heat transfer performance.

Figure 9:
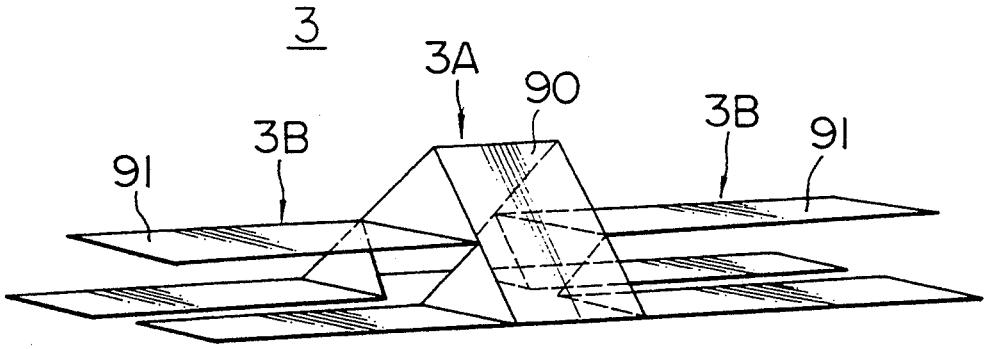
FIGS. 9 to 11 are perspective views of louver segments of fins in accordance with other embodiments of the present invention.

In the embodiment illustrated in FIG. 9, the central portion 3A of each louver segment 3 comprises a relatively large inclined part 90 having an inclined flat plate-shaped section taken in the direction of the flow of the fluid, while each of the end portions 3B comprises a plurality of (three, in the illustrated example) small parts 91 each having a flat plate-shaped section in the direction of the flow of the fluid. This embodiment provides advantages similar to those provided by the preceding embodiment.

Figure 10:
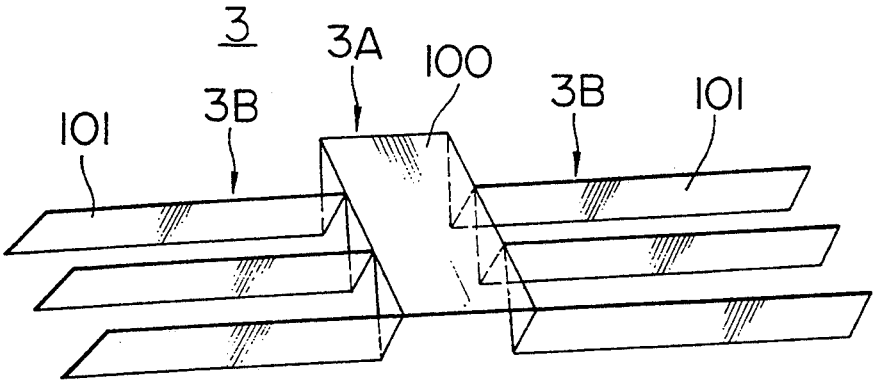

In the embodiment illustrated in FIG. 10, the central portion 3A of each louver segment 3 comprises a relatively large inclined part 100 having an inclined flat plate-shaped section taken in the direction of the flow of the fluid, while each of the end portions 3B comprises a plurality of (three, in the illustrated example) small inclined parts 101 each having an inclined flat plate-shaped section in the direction of the flow of the fluid. The embodiment illustrated in FIG. 10 also provides advantages similar to those of the preceding embodiments.

Figure 4:
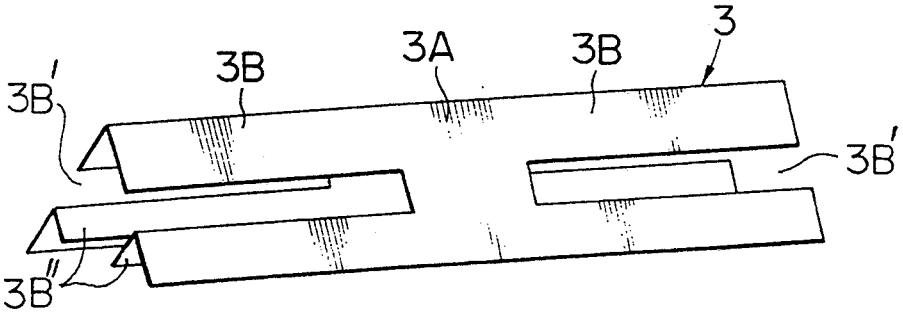
FIG. 4 is a perspective view of a single, angled louver segment.
Figure 11:
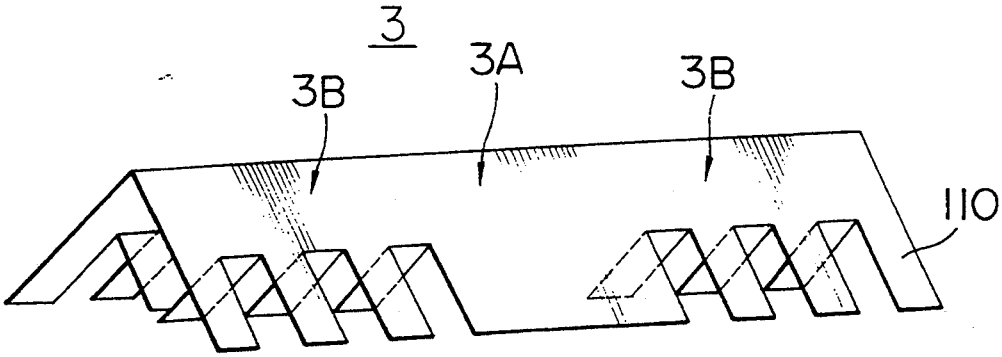

In the embodiment illustrated in FIG. 11, that part of each louver segment 3 which form the central portion 3A has an angled section in the direction of the flow of the fluid, as in the louver segment shown in FIG. 4, and each end portion 3B comprises a comb-shaped part 110 in which fin flaps are cut and bent from the foot of the basic angled part this embodiment also provides advantages similar to those provided by the preceding embodiments.

Figure 12:
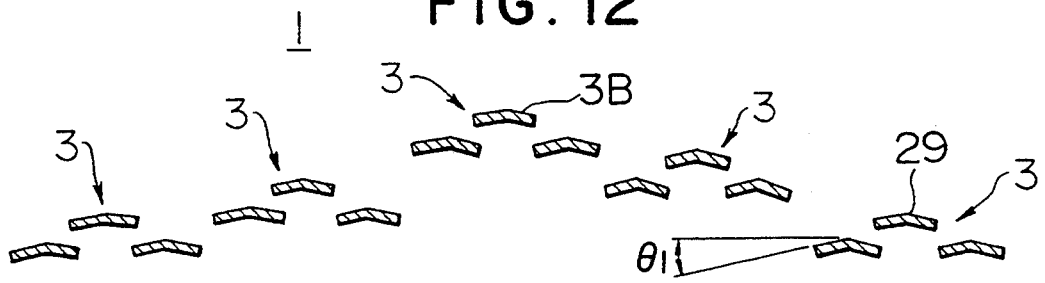
FIGS. 12 to 25 are enlarged sectional views of longitudinal end and central portions of louver segments of fins in accordance with further embodiments of the present invention.
Figure 13:
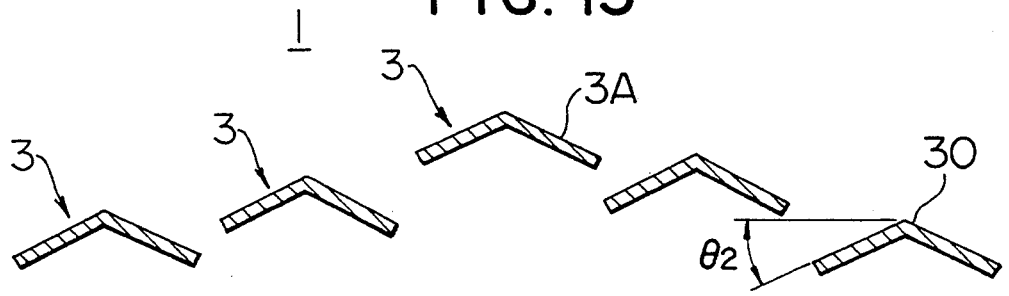

A further embodiment of the present invention will be described with reference to FIGS. 12 and 13, wherein a louver part, forming the central portion 3A between two adjacent heat transfer tube contact portions 2, is angled at an angle $\theta 2$ larger than the angle $\theta 1$ at which the louver part forming an end portion 3B on either side of the central portion 3A is angled. By virtue of the arrangement, this embodiment of FIGS. 14 to 25, provides a better control of the fluid speed flow speed than the embodiment illustrated in FIG. 4, thereby assuring a further reduction in the pressure loss.

Figure 14:
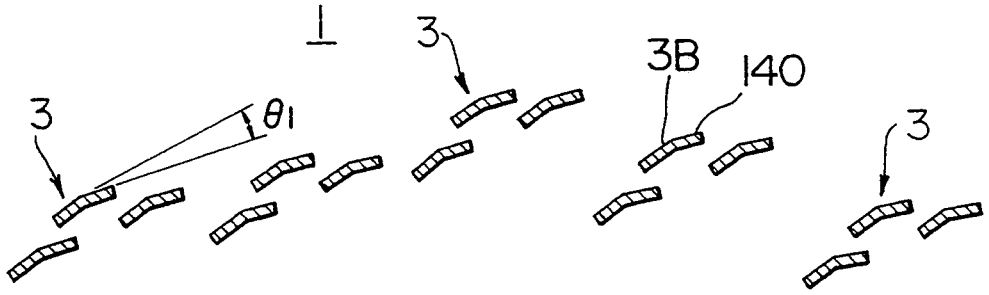
Figure 15:
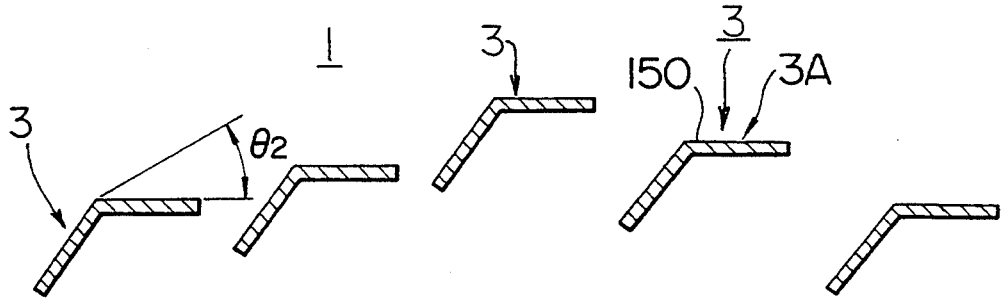
Figure 16:
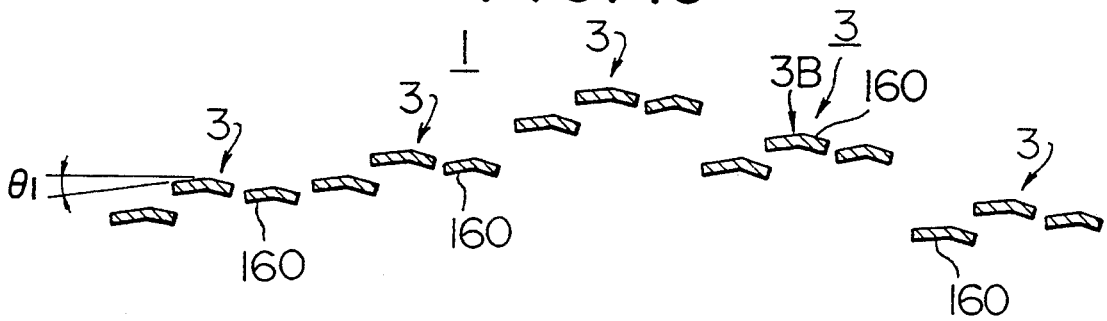
Figure 17:
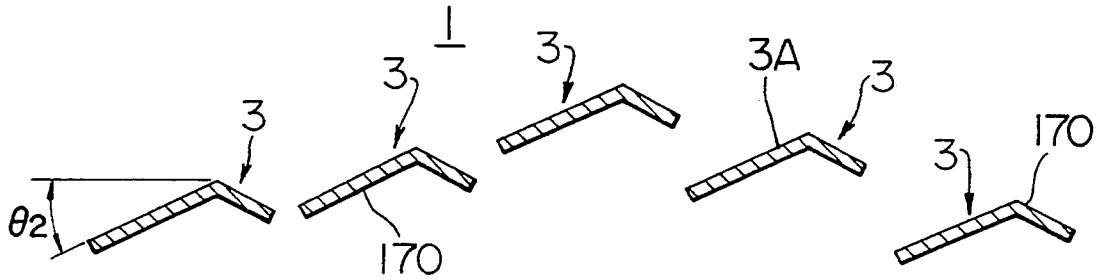
Figure 18:
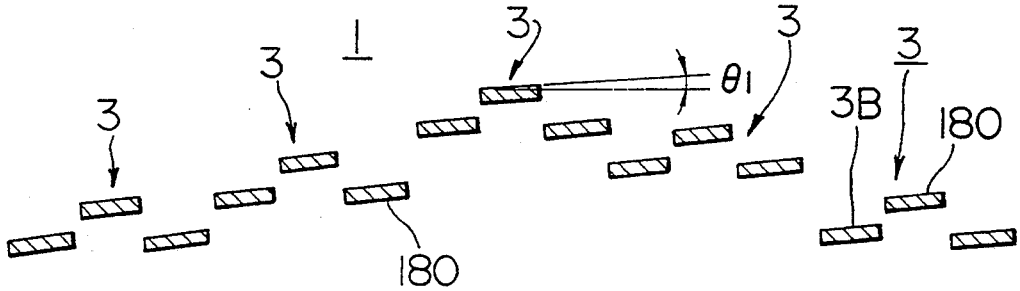
Figure 19:
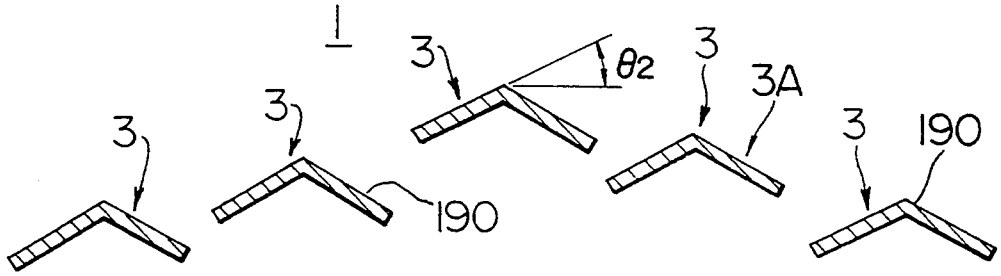

In the embodiment illustrated in FIGS. 14 and 15, that part of each louver segment 3 forming the end portion 3B comprises a plurality of small, inclined and angled parts 140, as shown in FIG. 14, while that part of each louver segment 3 forming the central portion 3A comprises an inclined angled part 150, as shown in FIG. 15. In the embodiment illustrated in FIGS. 16 and 17, that part of each louver segment 3 forming the end portion 3B comprises a plurality of small, asymmetric and angled parts 160, as shown in FIG. 16, while that part of each louver segment 3 forming the central portion 3A comprises an asymmetric angled part 170, as shown in FIG. 17. In the embodiment shown in FIGS. 18 and 19, that part of each louver segment 3 forming the end portion 3B comprises a plurality of small, inclined and flat parts 180, as shown in FIG. 18, while that part of each louver segment forming the central portion 3A comprises an angled part 190, as shown in FIG. 19.

Figure 20:
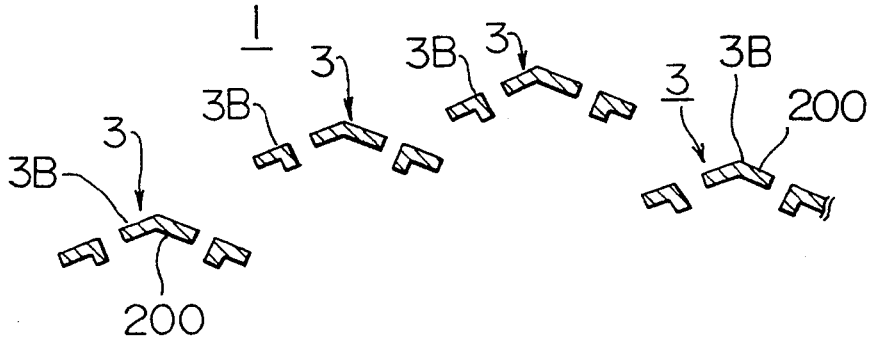
Figure 21:
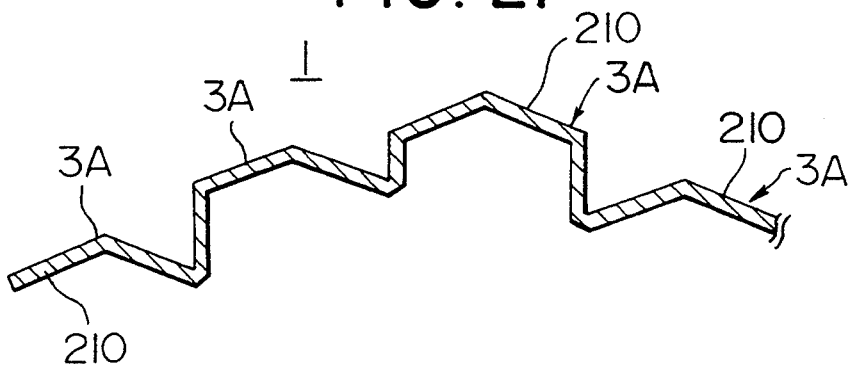
Figure 22:
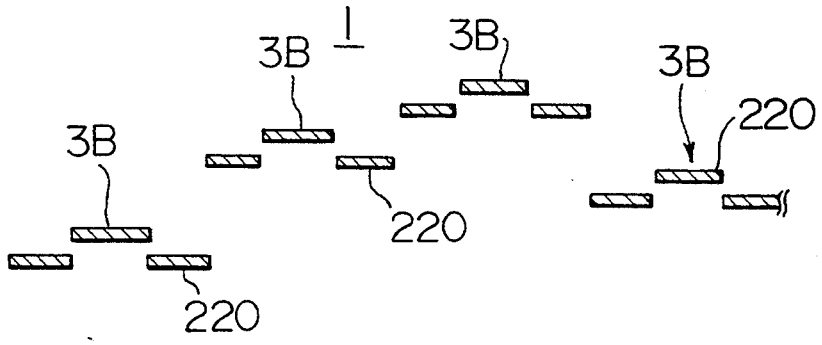
Figure 23:
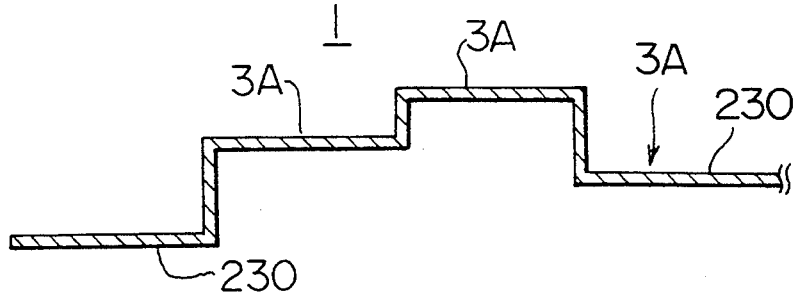
Figure 24:
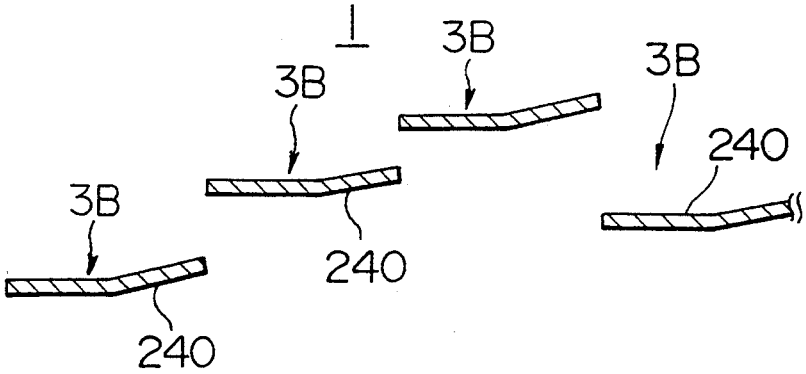
Figure 25:
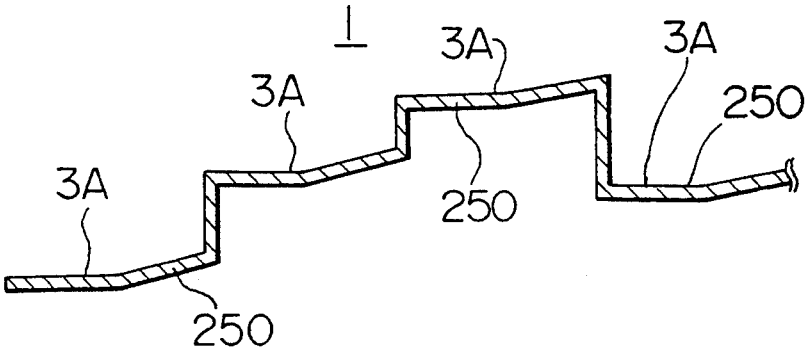

Further, in the embodiment shown in FIGS. 20 and 21, that part of each louver segment 3 forming the end portion 3B comprise a plurality of small, angled parts 200, as shown in FIG. 20, while that part of each louver segment 3 forming the central portion 3A comprises angled part 210 continuous with adjacent angled central portion 3A of an adjacent louver segment 3 as shown in FIG. 21. The embodiment of FIGS. 20 and 21 assures a further enhancement in the rigidity of the fin as compared with the embodiment illustrated in FIG. 4. For a similar purpose, that part of each louver segment 3 forming the end portion 3B may alternatively comprise a plurality of small, flat parts 220, as shown in FIG. 22, while that part of each louver segment 3 forming the central portion 3A may alternatively comprise a flat part 230 which is connected stepwise to an adjacent flat central portion 3A, as shown in FIG. 23. Furthermore, that part of each louver segment 3 forming the end portion 3B may alternatively comprise a small, valley-shaped parts 240, as shown in FIG. 24, while that part of each louver segment 3 forming the central portion 3A may alternatively comprise a part 250 which is connected stepwise to an adjacent central portion 3A, as shown in FIG. 25.

Figure 26:
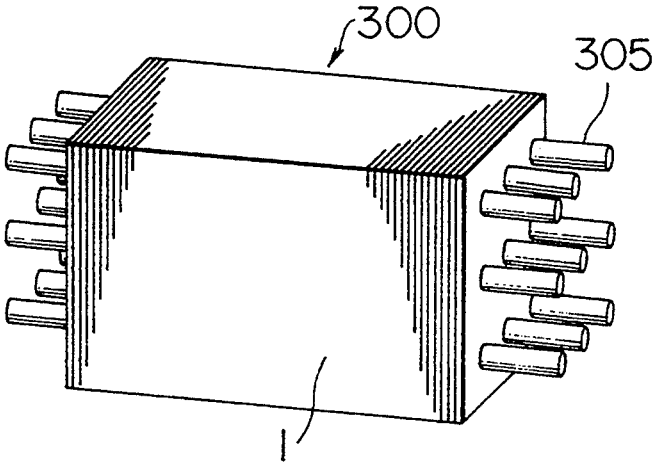
FIG. 26 is a perspective view of a heat exchanger in accordance with a still further embodiment of the present invention.

A plurality of the fin base plates 1 each described above are stacked in a direction crossing the direction in which the fluid flows, and they are brought into contact with heat transfer tubes 305 to form a heat exchanger 300, as shown in FIG. 26.

Figure 27:
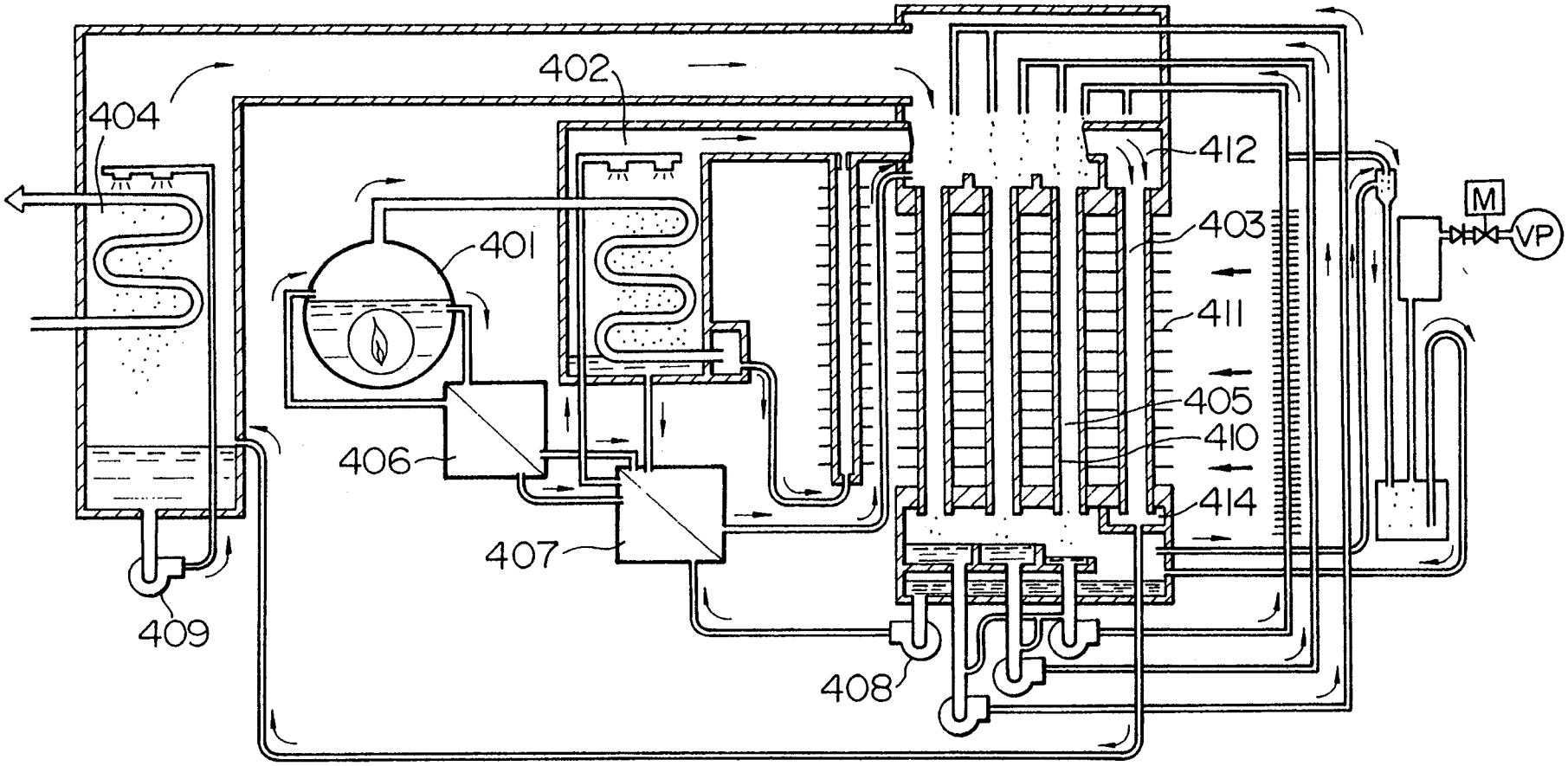
FIG. 27 is a view showing an example of the arrangement of an air-cooled absorption-type water heater cooler in which heat transfer fins of the present invention are incorporated.

The heat transfer fins of the present invention may be used in an absorber and/or evaporator of an air-cooled absorption-type water cooler heater. FIG. 27 shows the arrangement of such an air-cooled absorption-type water cooler heater. The apparatus has a high-temperature regenerator 401, a low-temperature regenerator 402, a condenser 403, an evaporator 404, an absorber 405, a high-temperature heat exchanger 406, a low-temperature heat exchanger 407, a circulating pump 408 and a refrigerant spraying pump 409.

The absorber 405 comprises a plurality of rows of air-cooled heat exchangers 411 in which heat transfer fins each described above are stacked on the outside of vertical tubes 410. The condenser 403 is formed by providing headers 412 and 414 on the upper and lower portions of that heat exchanger which is close to the cooling-air inlet. By virtue of the above-described arrangement, when absorbing liquid is sprayed onto the upper portions of the vertical pipes 410, the absorbing solution in the absorbing process can be circulated at a rate higher than the flow rate of the absorbing solution from the regenerators into the absorber 405. Accordingly, the absorbing solution in the absorbing process can be circulated at a flow rate corresponding to the cooling capacity of the cooling air flowing in contact with the vertical tubes 410, thereby enabling the absorbing solution to have a concentration level which is approximately the lowest of the concentration obtainable with the cooling capacity of the passing cooling air, and thus ensuring a high level of heat transferring performance.

As has been described above, according to the present invention, since the flow speed can be controlled in such a manner that the flow speed is higher where the difference in temperature between the fluid and the fin is large, it is possible to achieve an improvement in the heat transferring performance. In addition, since the louvers can be sectioned into small parts without causing any reduction in the strength of the entire fin, it is possible to achieve an enhancement in the heat transferring performance provided by an increase in the upstream-edge effect, while achieving an enhancement in the reliability of the fin in terms of its strength.

What is claimed is:

1. A heat transfer fin for a heat exchanger having at least two heat transfer tubes for a first fluid flowing therethrough, said fin comprising a fin plate including at least two tube mounting sections spaced from each other and a louvered section extending between and connected to said two tube mounting sections;

said tube mounting sections having collars defining therein tube mounting holes for receiving therein said heat transfer tubes in heat transfer contact with said collars so that a second fluid can flow through a passage between said heat transfer tubes and across said louvered section in heat transfer relationship therewith;

said louvered section having a plurality of elongated and substantially parallel louver segments arranged in the direction of the flow of said second fluid and extending substantially in parallel with a line extending between axes of said tube mounting holes in said at least two tube mounting sections;

said louver segments having substantially parallel longitudinal side edges separated from each other;

each of said elongated louver segments having longitudinal end portions respectively integrally connected to said two tube mounting sections and a longitudinal central portion extending between and integrally connected to said longitudinal end portions;

said louver segments being arranged so that adjacent louver segments delimit an opening therebetween over at least said longitudinal end portions;

each of said elongated louver segments having an angled configuration as viewed in its section taken in a plane substantially parallel to the direction of the flow of said second fluid and substantially parallel to said axes of said tube mounting holes, so that each of said louver segments imparts a resistance to the flow of said second fluid across said louvered section;

each of said longitudinal end portions of each of said elongated louver segments having an upper surface and a lower surface and at least one slit extending from the upper surface tot he lower surface between said openings defined between adjacent louver segments which allows a part of said second fluid flow to pass therethrough so that the resistance imparted by each louver segment to said second fluid flow is reduced in each of said longitudinal end portions by the presence of said at least one slit to allow said second fluid to flow at a higher speed at zones of said passage adjacent said heat transfer tubes than at a central zone of said passage adjacent said longitudinal central portions of each louver segment;

and said longitudinal central portions of each of said elongated louver segments is a solid non-slitted member between said openings defined between adjacent segments.

2. A heat transfer fin according to claim 1, wherein each louver segment is provided with two inclined walls by said angled configuration and said slits in each longitudinal end portion are formed in said two inclined walls, respectively.

3. A heat transfer fin according to claim 2, wherein each of said slits is delimited partly by a surface oriented at an angle measured between said surface and a second plane parallel to the direction of the flow of said second fluid and perpendicular to said axes of said tube mounting holes.

4. A heat transfer fin according to claim 1, wherein said slits extend longitudinally of the elongated louver segment to divide each of the longitudinal end portions into a plurality of small parts arranged in the direction of the flow of said second fluid and extending longitudinally of the elongated louver segment.

5. A heat transfer fin according to claim 1, wherein the longitudinal central portion of each of said elongated louver segments is connected, without any openings, to an adjacent longitudinal central portion.

6. A heat exchanger comprising:

at least two substantially parallel heat transfer tubes for a first fluid flowing therethrough; and a plurality of heat transfer fine stacked in the axial direction of said heat transfer tubes and mounted thereon;

each of said heat transfer fine comprising a fin plate including at least two tube mounting sections spaced from each other and a louvered section extending between and connected to said tube two mounting sections;

said tube mounting sections having collars defining therein tube mounting holes through which said heat transfer tubes extend in heat transfer contact with said collars;

the stacked heat transfer fins being spaced one from another by the collars of said stacked fins;

said heat transfer tubes cooperating to define therebetween a passage, the louvered sections of the stacked fins extending across said passage so that a second fluid can flow through said passage across each of the louvered sections of the stacked heat transfer fins in heat transfer relationship therewith;

said louvered section of each fin having a plurality of elongated and substantially parallel louver segments arranged in the direction of the flow of said second fluid and extending substantially in parallel with a line extending between axes of said tube mounting holes in said at least two tube mounting sections;

said louver segments of each fin having substantially parallel longitudinal side edges separated from each other;

each of said elongated louver segments of each fin having longitudinal end portions respectively integrally connected to said two tube mounting sections of each fin and a longitudinal central portion extending between and integrally connected to said longitudinal end portions of each louver segment;

said louver segments of each fin being arranged so that adjacent louver segments delimit an opening therebetween over at least said longitudinal end portions;

each of said elongated louver segments of each fin having an angled configuration as viewed in its section taken in a plane substantially parallel to the direction of the flow of said second fluid and substantially parallel to said axes of said tube mounting holes, so that each of said louver segments of each fin imparts a resistance to the flow of said second fluid across the louvered section of each fin;

each of said longitudinal end portions of each of said elongated louver segments of each fin having an upper surface and a lower surface and at least one slit extending from the upper surface to the lower surface between said openings defined between adjacent louver segments which allows a part of said second fluid flow to pass therethrough so that the resistance imparted by each louver segment of each fin to said second fluid flow is reduced in each of said longitudinal end portions of each louver segment of each fin by the presence of said at least one slit to allow said second fluid to flow at a higher speed at zones of said passage adjacent said heat transfer tubes than at a central zone of said passage adjacent said longitudinal central portion of each louver segment of each fin;

and said longitudinal central portions of each of said elongated louver segments of each fin is a solid non-slitted member between said openings defined between adjacent louver segments of each fin.

7. A heat exchanger according to claim 6, wherein each of the louver segments of each fin is provided with two inclined walls by said angled configuration and said slits in each longitudinal end portion of each louver segment of each fin are formed in said two inclined walls, respectively.

8. A heat exchanger according to claim 7, wherein each of the slits in each louver segment of each fin is delimited partly by a surface oriented at an angle measured between said surface and a second plane parallel to the direction of the flow of said second fluid and perpendicular to said axes of said tube mounting holes.

9. A heat exchanger according to claim 6, wherein said slits in each longitudinal end portion of each louver segment of each fin extend longitudinally of the louver segment to divide each of the longitudinal end portions of each louver segment into a plurality of small parts arranged in the direction of the flow of said second fluid and extending longitudinally of the louver segment.

10. A heat exchanger according to claim 6, wherein the longitudinal central portion of each of said elongated louver segments of each fin is connected, without any openings, to an adjacent longitudinal central portion.

* * * * *